United States Patent [19]

Weingarten

[11] Patent Number: 4,700,760

[45] Date of Patent: Oct. 20, 1987

[54] INVESTMENT CASTING MOLD BASE

[76] Inventor: Joseph L. Weingarten, 1927 Oak Tree Dr. E.,, Dayton, Ohio 45440

[21] Appl. No.: 261,360

[22] Filed: May 7, 1981

[51] Int. Cl.[4] ..... B22C 7/02; B22C 9/04

[52] U.S. Cl. ..... 164/244; 164/237

[58] Field of Search ..... 164/244, 237, 238, 376, 164/DIG. 4, DIG. 15, 359, 362

[56] References Cited

U.S. PATENT DOCUMENTS

| | | | |
|---|---|---|---|
| 865,823 | 9/1907 | Taggart | 164/238 |
| 1,639,253 | 8/1927 | Ayers | 164/DIG. 4 |
| 1,939,479 | 12/1933 | Williams | 164/237 |
| 2,845,667 | 8/1958 | Frischknecht | 164/359 |
| 3,295,175 | 1/1967 | Krzyzanowski | 164/34 |
| 3,322,187 | 5/1967 | Weissman | 164/376 |
| 3,610,317 | 10/1971 | Benfield et al. | 164/238 |
| 3,731,726 | 5/1973 | Eberle | 164/7.1 |
| 3,768,544 | 10/1973 | Padeh | 164/244 X |
| 3,985,178 | 10/1976 | Cooper | 164/237 |
| 4,081,019 | 3/1978 | Kulig | 164/34 |
| 4,161,208 | 7/1979 | Cooper | 164/244 |

FOREIGN PATENT DOCUMENTS

| | | | |
|---|---|---|---|
| 25365 | 10/1922 | France | 164/376 |

*Primary Examiner*—Nicholas P. Godici
*Assistant Examiner*—J. Reed Batten, Jr.
*Attorney, Agent, or Firm*—John R. Flanagan; Donald J. Singer

[57] ABSTRACT

An investment casting mold base has an enlarged, ellipsoidal-shaped body overlying a frusto conical-shaped body on the base. The enlarged body will form a molten metal staging cavity between a funnel cavity at the entrance of the mold formed by the frusto conical body and sprue channels leading to the article cavity in the mold. The staging cavity eliminates backup of molten metal at the mold entrance and possible spillover of the metal from the crucible mated to the mold during the centrifugal casting operation.

1 Claim, 4 Drawing Figures

INVESTMENT CASTING MOLD BASE

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

The present invention broadly relates to centrifugal casting of articles from molten metal and, more particularly, is concerned with a flexible base for use in making investment casting molds.

2. Description of the Prior Art

Metallic articles requiring detailed precision have been manufactured for many years by what was historically called the "lost wax" process. In more recent years, the process has become known as investment casting. The steps of the process may be divided into the two successive phases of: (I) investing, and (II) casting.

The basic steps occurring in the initial investing phase are: (a) creating a wax or plastic model of the article to be cast, (b) mounting the model and sprue forming rods made from the same or similar material on a rubber base, (c) placing a steel flask on the base around the mounted model, and (d) pouring suitable investment plaster into the container formed by the base and flask and allowing the investment to harden for five to ten minutes.

The final casting phase covers the steps of: (e) removing the rubber base from the flask after the investment has hardened sufficiently, (f) heating the flask containing the investment to between 900 and 1200 degrees F. to melt out the wax or plastic model and sprue rods, leaving an investment mold having negative voids or hollow channels and cavities in their place, (g) casting the desired article by (1) pouring, (2) pouring with vacuum assistance, or (3) centrifugally forcing, molten metal from a crucible into the investment mold cavities, wherein the metal cools and hardens to form the desired article, (h) destroying the investment mold in order to retrieve the formed article therefrom, and (i) finishing the article by machining off the connection with the metal of the sprue channels.

In step (j), casting the article by either pouring, with or without vacuum, molten metal from the crucible into the investment mold cavities, the speed at which the metal moves into the mold can be controlled. Consequently, if one finds that the metal being poured is overflowing the capacity of the sprue channels to feed the mold cavities, the rate of pouring can be decreased.

However, in casting molten metal by centrifugally forcing it into the mold cavities, one cannot control the speed at which it moves into the mold. Due to this lack of control, spillover of the molten metal out through the open top end of the crucible adjacent the mold frequently occurs. This is hazardous in view of the high temperatures involved and also wasteful and expensive in view of the high cost of metals, such as titanium, gold, or silver, commonly being cast. Also, some metal cools at the entrance to the mold, blocking the passage of sufficient molten metal into the mold to complete the casting of the article.

Common practice to overcome this spillover problem has been to increase the feeding capacity to the mold cavities such as by increasing the number of sprue channels or, alternatively, making them wider. However, this practice has several drawbacks. First, the machining time required to finish the final article is increased due to the greater surface area of contact between the metal residue of the sprue channels and the article. Second, a greater expenditure of material and energy results since it takes more wax material to form the sprue channels now greater in number or size than before, it takes more heat energy to melt out this increased quantity of material, and it requires a greater quantity of metal during the casting step to ensure completion of the casting product. Therefore, it is readily apparent that the above-described common practice has failed to provide a satisfactory solution to the metal spillover problem arising during the centrifugal investment casting process.

SUMMARY OF THE INVENTION

The present invention provides a solution to the spillover problem without the attendant drawbacks of the prior common practice and, in fact, allows reduction of the earlier number of sprue channels required, or, in the alternative, allows larger, or a greater number of, items to be cast per mold with the same number of sprue channels. The savings in sprue rod and investment materials and energy required is readily apparent. Furthermore, the finishing time is reduced.

The solution of the present invention relates to the provision of a molten metal holding or staging cavity between the entrance of the mold and the sprue channels which eliminates the backup of molten metal at the entrance without attempting to control the rate of metal movement into the mold.

Accordingly, the present invention provides a flexible base for use in making investment casting molds, which comprises: (a) a disc-shaped base plate; (b) an upstanding annular flange connected to and extending about the periphery of the plate; (c) a generally cylindrical-shaped body connected to and extending upwardly from a central portion of the plate for forming a funnel cavity in the mold; and (d) a generally enlarged ellipsoidal-shaped body connected to and overlying the cylindrical-shaped body and extending laterally beyond the outer perimeter thereof so as to overlie, but be spaced above, an annular portion of the plate between the flange and the cylindrical-shaped body, the enlarged body being provided for forming a molten metal staging cavity in the mold. The enlarged body has a cylindrical depression defined therein for mounting a part for forming at least one sprue channel in the mold.

DETAILED DESCRIPTION OF THE INVENTION

Figure 1:
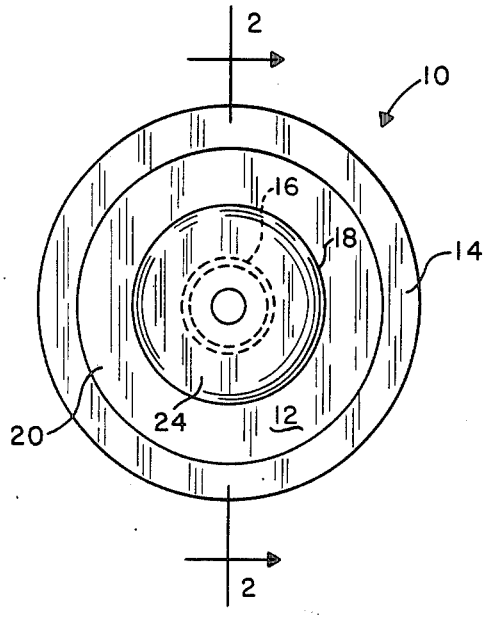
FIG. 1 is a top plan view of the flexible base of the present invention.
Figure 2:
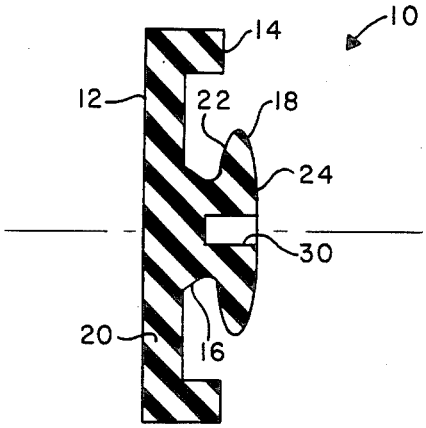
FIG. 2 is a cross sectional view of the base taken along line 2—2 of FIG. 1.

Referring now to the drawings, and particularly to FIGS. 1 and 2, there is shown the preferred embodiment of the investment casting mold base of the present invention, being generally designated 10.

The base 10 includes a generally circular disc-shaped plate 12 having an upstanding annular flange 14 integrally connected with and extending about the periphery of the plate 12. Also, included in the base 10 are a generally cylindrical, or, more particularly, a frusto conical-shaped, body 16 and a generally enlarged ellipsoidal-shaped body 18. The frusto conical body 16 is integrally connected with and extends upwardly from a central portion of the base plate 12. The enlarged body 18 is integrally connected with and overlies the frusto conical body 16 and also extends laterally beyond the outermost perimeter of the body 16 so as to overlie, and be spaced above, an annular portion 20 of the plate 12 located between the flange 14 and the frusto conical body 16. The enlarged body 18, by preferably being somewhat ellipsoidal in shape, has flattened bottom and top surfaces 22, 24.

Figure 3:
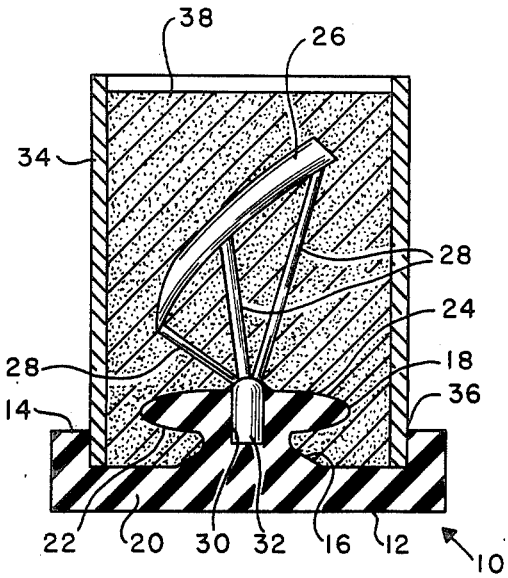
FIG. 3 is an elevational view, partly in section, of an investment mold contained by a metal flask supported on the flexible base with the wax mold and sprue forming rods mounted on the base.

For mounting a wax or plastic model 26 of an article, such as a turbine blade, to be cast and a plurality of sprue rods 28 made of the same material, as illustrated in FIG. 3, a cylindrical depression 30 is formed in the enlarged body 18 so as to open at the top surface 24 thereof. A post 32 made from wax or plastic and connected to the sprue rods 28 inserts into the depression 30 in the manner seen in FIG. 3.

The base 10 is to be used with a cylindrical casting flask 34. The annular flange 14 is adapted to receive and fit tightly about a lower end 36 of the casting flask 34. Together the base 10 and flask 34 form a container or receptacle surrounding the wax or plastic model and sprue rods and into which a quantity of liquid investing material, such as a high grade investment plaster, is poured and will fill all the empty space within the container. After five to ten minutes the investment material will harden into the form of mold 38. Then the base 10 may be removed. The base 10 is sufficiently flexible, being preferably made from natural rubber, that it may be readily removed from engagement with the flask 34 and mold 38. The model and sprue rods are then melted or burned out of the mold 38 by heating it up to between 900 to 1200 degrees F.

Figure 4:
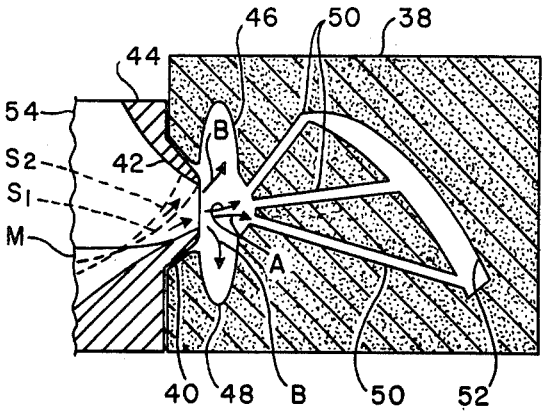
FIG. 4 is an elevational view, in section, of the investment casting mold mated with a crucible containing molten metal and illustrated in fragmentary form.

By comparing FIGS. 3 and 4, it is seen that the space occupied by the frusto conical body 16 of the base 10 forms a funnel cavity 40 in the mold 38 shaped to receive an outlet 42 of a crucible 44 containing molten casting metal M. The space occupied by an annular or outer ring portion 46 of the enlarged ellipsoidal-shaped body 18 forms a molten metal holding or staging cavity 48 in the mold 38 between the funnel cavity 40 at the mold entrance and sprue channels 50 formed when the mold 38 was heated up and the wax or plastic was melted or burned out of the mold. The sprue channels 50 are all aligned at their entry ends with the funnel cavity 40 while the annular staging cavity 48 is located outside the direct path (arrows A in FIG. 4) of movement of the molten metal M to the sprue channels 50 from the crucible outlet 42.

When the crucible 44 and mold 38 are mated together as seen in FIG. 4 and revolved together in a horizontal plane about a common vertical axis, centrifugally-directed forces move the molten metal such that its top surface in the crucible 44 successively progresses through the positions depicted by broken lines $S_1$ and $S_2$ in FIG. 4. This happens almost instantaneously once the revolution of the crucible and mold have commenced. The sprue channels 50 leading to the article cavity 52 (left when the wax or plastic model 26 was melted or burned out) quickly fill up to capacity with molten metal. The additional metal rushing into the mold 38 then flows in the direction of arrows B into the annular staging cavity 48, preventing the level of the molten metal M in the crucible 44 to continue upward through the top opening 54 of the crucible 44. As the metal continues to move through the sprue channels 50, filling the article cavity 52, supply of the molten metal to the sprue channels 50 may be replenished from the staging cavity 48.

As seen in FIG. 2, the region of connection at the upper end of the frusto conical body 16 between the body 16 and the enlarged ellipsoidal-shaped body 18 is substantially smaller in diameter than the lateral or major diameter of the enlarged body 18. Referring to FIG. 4, it is seen that the region of connection occupies the space which forms the opening in the mold 38 which communicates the funnel cavity 40 of the mold with the molten metal holding cavity 48 of the mold. The reduced size of the opening between the funnel cavity 40 and the holding cavity 48 minimizes the amount of heat loss from the molten casting metal in the cavity 48 due to exposure to atmosphere. In other words, the molten metal within the holding cavity 48 is substantially surrounded by the heated mold 38 which significantly reduces or even eliminates the probability of metal hardening and consequent blocking of metal flow through the mold entrance. Consequently, there is no blockage of the mold entrance nor molten metal spillover. The metal continues to flow into the article cavity 52 until it is completely filled. The casting process thereby proceeds in an orderly manner irrespective of the speed at which the molten metal is fed into the mold by centrifugal forces.

It is thought that the flexible base of the present invention and many of its attendant advantages will be understood from the foregoing description and it will be apparent that various changes may be made in the form, construction and arrangement of the parts thereof without departing from the spirit and scope of the invention or sacrificing all of its material advantage, the form hereinbefore described being merely a preferred or exemplary embodiment thereof.

Having thus described the invention, what is claimed is:

1. A flexible base for use with a cylindrical casting flask for making an investment casting mold to be used in centrifugal casting of articles from molten metal, comprising:

(a) a generally circular base plate:

(b) an upstanding annular flange integrally connected with and extending about the periphery of said base plate and adapted to fit tightly about a lower end of said casting flask;

(c) a generally frusto conical-shaped body integrally connected with and extending upwardly from a central portion of said base plate for forming a funnel cavity in the mold in which to receive an outlet of a molten metal crucible during centrifugal casting of articles in the mold; and (d) a generally enlarged ellipsoidal-shaped body integrally connected with an upper end of said frusto conical-shaped body, said enlarged body overlying and extending laterally beyond said frusto conical-shaped body so as to also overlie, but be spaced above, said base plate between said flange and said frusto conical-shaped body, said enlarged body having defined therein a cylindrical depression for mounting a part for forming all sprue channels in the mold in alignment with said funnel cavity formed by said frusto conical-shaped body, the portion of said enlarged body extending laterally beyond said frusto conical-shaped body being provided for forming a molten metal staging cavity in the mold which is located outside the direct path of movement of the molten metal to the sprue channels in the mold from the outlet of the crucible when received in said funnel cavity formed by said frusto conical-shaped body of said base, said upper end of said frusto conical-shaped body at its connection to said enlarged body being substantially smaller in diameter than the lateral diameter of said enlarged body so as to provide an opening in the mold between said funnel and molten metal staging cavities thereof of a reduced size which minimizes the potential heat loss from molten metal in said staging cavity.

* * * * *